US005271375A

United States Patent [19]

Ekermans

[11] Patent Number: 5,271,375

[45] Date of Patent: Dec. 21, 1993

[54] MONITORING OF GAS FLOW

[76] Inventor: Wilhelm E. Ekermans, P.O. Box 14136, Green Point, Cape Town, South Africa, 8051

[21] Appl. No.: 807,763

[22] Filed: Dec. 6, 1991

Related U.S. Application Data

[63] Continuation of Ser. No. 537,346, Jun. 13, 1990, abandoned.

[51] Int. Cl.[5] ..... F24C 3/00

[52] U.S. Cl. ..... 126/39 BA; 126/39 R; 137/392; 431/73

[58] Field of Search ..... 126/39 BA, 39 R, 39 E, 126/39 N, 52; 250/554, 577, 231 P, 564; 137/392; 73/290 R, 293, 291, 305-307, 313, 314; 431/73

[56] References Cited

U.S. PATENT DOCUMENTS

| | | | |
|---|---|---|---|
| 2,865,993 | 10/1958 | Juneau . | |
| 3,510,237 | 5/1970 | Giranieri . | |
| 4,016,425 | 4/1977 | Farquhar et al. . | |
| 4,069,838 | 1/1978 | Hansel et al. | 137/392 |
| 4,073,611 | 2/1978 | Kaduki et al. . | |
| 4,125,355 | 11/1978 | Rozzi | 431/73 X |
| 4,370,126 | 1/1983 | Miyanaka et al. | 431/73 |
| 4,445,238 | 5/1984 | Maxhimer | 137/392 |
| 4,788,529 | 11/1988 | Lin | 126/39 RX |
| 4,934,925 | 6/1990 | Berlincourt | 431/73 X |

FOREIGN PATENT DOCUMENTS

| | | | |
|---|---|---|---|
| 0197334 | 8/1986 | European Pat. Off. . | |
| 1543193 | 3/1979 | United Kingdom | 431/73 |
| 2200193 | 1/1987 | United Kingdom . | |

*Primary Examiner*—Larry Jones

*Attorney, Agent, or Firm*—Gifford, Groh, Sprinkle, Patmore and Anderson

[57] ABSTRACT

A gas flow detection device having an inlet for connection to a source of gas and an outlet for connection to a gas-using appliance is disclosed. Gas for feeding a pilot flame of the appliance flows through a permanently open orifice. When the appliance is switched on the pressure at the devices outlet drops and a piston which is in a tube is lifted by gas pressure at the device's inlet. Gas then flows from the inlet to the outlet. A light source and a light sensitive cell provide a signal that indicates that the piston has lifted. A monitoring system which makes use of the signal provided by the cell is also disclosed.

10 Claims, 2 Drawing Sheets

MONITORING OF GAS FLOW

This is a continuation of copending application(s) Ser. No. 0 7/537,346 filed on Jun. 13, 1990 now abandon.

BACKGROUND OF THE INVENTION

THIS INVENTION relates to a device for detecting gas flow and to a gas installation.

Liquid petroleum gas (known generally as LPG) is extensively used in recreational land vehicles such as caravans and campers and in marine craft such as yachts. It is also used in holiday cottages and homes which are in remote areas where there is no mains electricity supply and in numerous industrial and commercial applications.

Many deaths and injuries have resulted from accidents involving LPG. In some cases a gas leak has resulted in an explosion but more often in asphyxiation of people in the camper, caravan, yacht or house. Gas leaks can result from damage to a gas pipe or to the gas appliance but more frequently occur when gas flows through the main gas jets without being ignited.

SUMMARY OF THE INVENTION

The present invention seeks to provide a device which can monitor the flow of gas and provides a warning signal in the event that it detects a condition that could lead to a dangerous situation arising and which thereafter shuts-off the flow of gas.

According to one aspect of the present invention there is provided an installation comprising a source of gas and a gas-using appliance, characterised by a device for detecting gas flow and producing an output signal indicating gas flow, a timer which runs for a predetermined period and which produces an output signal during the timed period, and means for shutting off the gas flow in the event that there is an output signal indicating gas flow but no output signal from said timer.

The installation can include various forms of sensor. In one form there are sensor means for sensing if the pilot flame of the gas-using appliance is burning and causing said means to shut off gas flow in the absence of a pilot flame. The installation can further include sensor means responsive to the luminosity of the main flame of the appliance and for causing said means to shut off gas flow in the event that the luminosity of the main flame exceeds a predetermined level. Alternatively or additionally the installation can include a heat sensor for detecting the heat of the main flame of the appliance and for causing said means to shut off gas flow if it does not detect that the main flame is burning.

According to a further aspect of the present invention there is provided a device for incorporation into a gas flow monitoring installation, the device detecting gas flow and comprising an inlet for connection to a gas supply, an outlet for connection to a gas-using appliance, a movable element which is displaced upon there being a major gas flow through the device, and means for producing an output signal upon said element being displaced by a major gas flow.

Said device can include a vertical tube, said element being in said tube and free to move in said tube, the lower face of said element being exposed to the pressure at said inlet and the upper face of the element being exposed to the pressure at said outlet, said element, in use, lifting upon a major gas flow occurring, and said means detecting that said element has lifted.

Said detecting means can comprise a light source and a light sensitive cell, the element in one position preventing light from the source reaching said cell.

To adapt the device for use in conjunction with gas-using appliances that have pilot flames, the device is provided with an orifice connecting said inlet and said outlet and permitting a continuous minor gas flow through the device for the pilot flame of the appliance.

In one constructional form of device according to the invention said orifice places the lower end of said tube in communication with said outlet, and said tube has a hole in the wall thereof which is above the element while the element is in its lowermost position and below the element when the element is in its lifted position.

In another constructional form of the invention said orifice is in said element and places the space below the element permanently in communication with the space above the element.

BRIEF DESCRIPTION OF THE DRAWINGS

For a better understanding of the present invention, and to show how the same may be carried into effect, reference will now be made, by way of example, to the accompanying drawings in which.

DESCRIPTION OF THE PREFERRED EMBODIMENT

Figure 1:
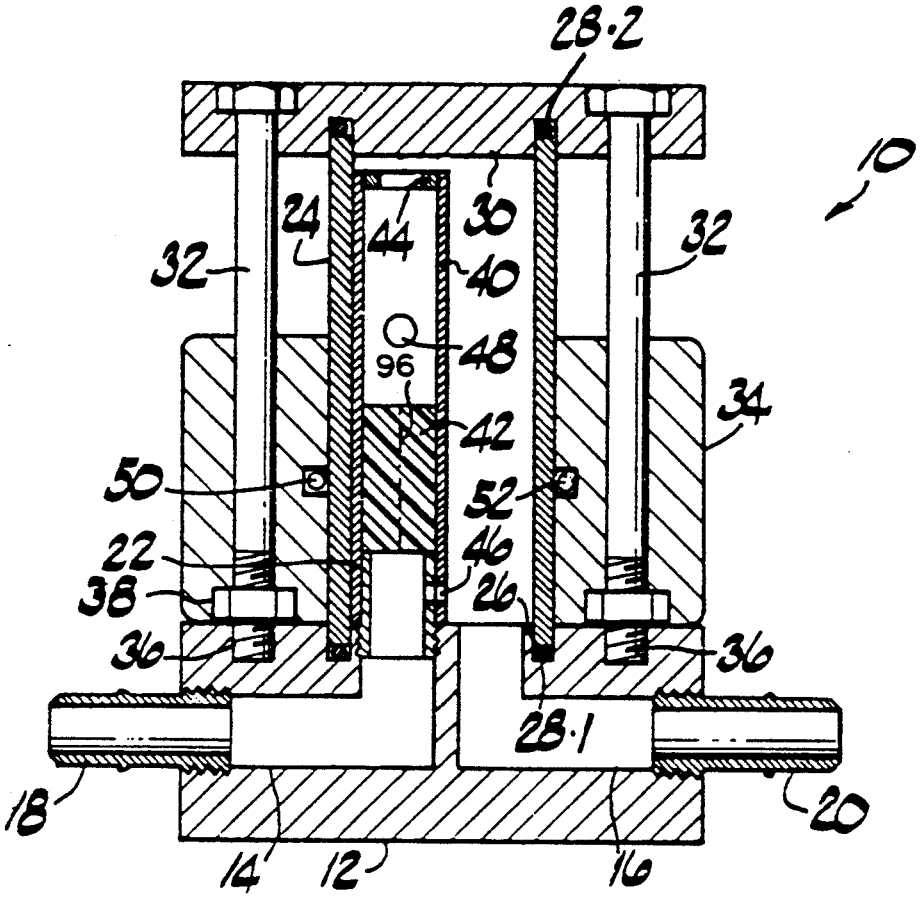
FIG. 1 is a vertical section through a device for detecting gas flow.

Referring firstly to FIG. 1, the device illustrated is designated 10 and comprises a base block 12 which has two bores 14 and 16 therein. Each bore 14, 16 has a right angled bend therein, the bores having entrances thereto in the top wall of the block and in the side wall of the block. Brass nipples 18 and 20 are screwed into the horizontal portions of the block 10 and a further brass nipple 22 is screwed into the upper end of the bore 14. Gas pipes (not shown in FIG. 1) fit onto the nipples 18 and 20. The pipe fitted to the nipple 18 leads via a solenoid operated valve (not shown in FIG. 1) to a gas cylinder or other source of inflammable gas. The pipe fitted to the nipple 20 leads to an appliance (not shown in FIG. 1) such as a gas stove or water heater.

A sleeve 24 has the lower end thereof inserted into a groove 26 provided in the top face of the block 12. There is a sealing ring 28.1 in the groove 26. The sleeve 24 is pressed into the groove 26 by means of a top cap 30 and a ring of bolts 32. The bolts 32 pass downwardly through the cap 30, through a collar 34 and into tapped blind bores 36 of the block 12. Nuts 38 on the lower ends of the bolts 32 are located in the countersunk lower ends of the bores in the collar 34. The heads of the bolts 32 are in the countersunk upper ends of the bores in the cap 30. The lower face of the cap 30 has a circular groove in it and there is a seal 28.2 in this groove. The upper end of the sleeve 24 is seated in this groove.

A vertical tube 40 is fitted over the nipple 22 and has therein an opaque piston 42. The piston is relatively light so that it can 'float' on the gas as a result of the pressure differential between the upper and lower faces thereof when there is a major gas flow. A stop 44 at the upper end of the tube 40 limits upward movement of the piston 42.

Small registering holes 46 in the nipple 22 and tube 40 form an orifice and place the bores 14 and 16 in communication with one another at all times. A further larger hole 48 in the tube 40 places the upper part of the tube 40 in communication with the chamber bounded by the block 12, top cap 30 and sleeve 24.

The collar 34 carries a light source 50 and, at a diametrically opposed position, a light sensitive cell 52. The piston 42 is between the light source and the cell when it is in the position shown in FIG. 1.

The device described operates in the following manner. Gas for the pilot flame of the appliance flows from the bore 14 to the bore 16 through the holes 46. The piston 42 prevents light from the source 50 reaching the cell 52. When the appliance is switched on, there is a pressure drop in the bore 16 and hence in the sleeve 24 and upper part of the tube 40. The pressure of the gas below the piston 42 lifts it to the upper end of the tube 40 so that gas can now flow from the bore 14 to the bore 16 through the hole 48. When the appliance is switched off the gas in the sleeve 24 and in the bore 16 is used up and the piston then sinks back to the position shown so that light ceases to reach the cell 52.

Experimental work has shown that the liquid which is to be found in LPG gas, and which comprises some water and what are known as the heavy-ends of the crude oil, assists in sealing between the piston 42 on the one hand and the tube 40 and the nipple 22 on the other hand. The liquid also acts as a lubricant between the piston 42 and the tube 40.

Figure 2:
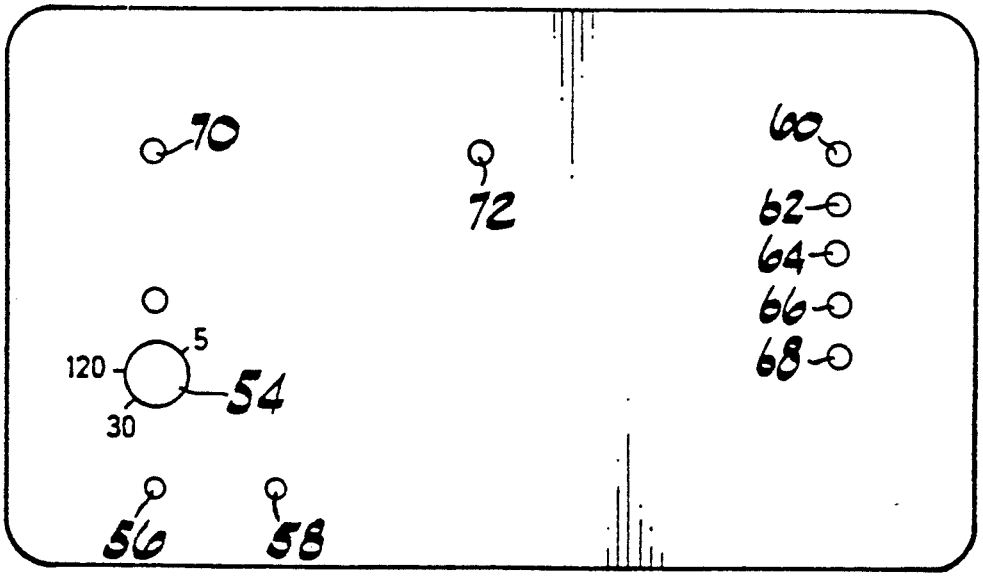
FIG. 2 is a front view of a control panel.

Turning now to FIG. 2, the control panel shown comprises a timer knob 54 which can be set for five, thirty or one hundred and twenty minutes. Below the timer knob 54 are two re-set buttons 56 and 58. The button 56 is to re-set the timer and the button 58 is to re-set the solenoid operated valve which is between the gas cylinder and the device 10.

Light emitting diodes (LED's) 60, 62, 64, 66 and 68 are provided for indicating respectively that there is an alarm condition (discussed in more detail below), that the voltage of the battery which powers the system is low, that the main flame is not burning correctly (discussed in more detail below), that the pilot flame has gone out, and that the solenoid operated valve is closed. Two other light emitting diodes 70 and 72 indicate that the system has electrical power supplied to it and that there is gas flow. This is also discussed in more detail below. The LED 60 has an audible warning device such as a buzzer associated with it.

Figure 3:
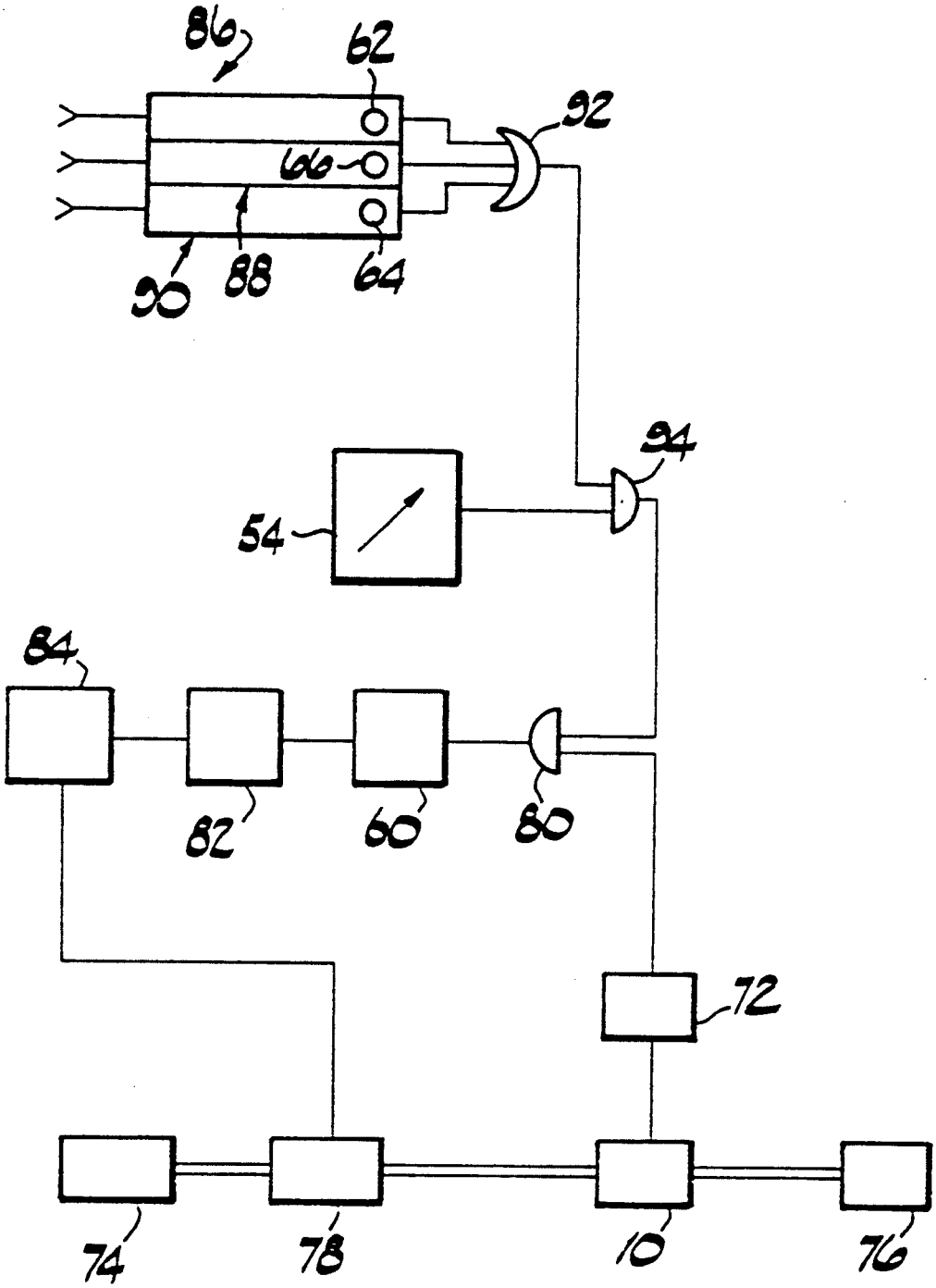
FIG. 3 is a schematic representation of a gas flow monitoring system.

Turning now to FIG. 3, the device 10 is shown connected in the gas line between a gas cylinder 74 and a gas appliance 76. A solenoid operated valve 78 is connected between the cylinder 74 and the device 10. Gas can flow continuously through the device 10 via its orifice for supplying a pilot flame.

The signal produced by the cell 52 when the piston lifts upon there being gas flow illuminates an LED 72 and is fed to an AND gate 80. The output of the gate 80 is fed to the LED 60 which indicates an alarm condition, to a series connected time delay device 82 and to a control unit 84 which is in turn connected to the solenoid operated valve 78.

Three sensors and their associated sensor circuits 86, 88 and 90 detect respectively the voltage level of the battery which powers the system, the presence of a pilot flame and the colour of the main flame when the appliance is on. The voltage level sensor circuit 86 provides a signal when the battery voltage drops from 12 volts to 9 volts. The sensor circuit 88 for the pilot flame includes a light sensitive cell and provides a signal in the absence of any light from the pilot flame. The sensor circuit 90 also includes a light sensitive cell and is set so that it produces a signal should the luminosity of the main flame increase unduly. A flame which is burning too yellow is an indication of a fault in the appliance. The LEDs 62, 64 and 66 are shown associated with the detector circuits 86, 88 and 90 and are illuminated when any sensor circuit provides a signal indicating improper functioning of the appliance or a low voltage.

The output from the sensor circuits 86, 88 and 90 are fed to an OR gate 92 and the output from the OR gate forms one of the inputs to an AND gate 94. The other input of the AND gate 94 is received from the timer which is controlled by the knob 54.

While the voltage level detector 86 and pilot flame detector 88 are providing signals which indicate that the voltage level is above the minimum acceptable value and that there is a pilot flame then no signal is fed to the AND gate 94. It will be understood that as the main flame is off at this stage the detector circuit 90 will not be providing a signal indicating an improper condition.

When the timer is set to run for five, thirty or one hundred and twenty minutes then it ceases to provide a signal to the AND gate 94 which then provides a signal to the AND gate 80. Upon the appliance being switched on the piston 42 lifts and a further signal is applied to the AND gate 80 by the device 10. Simultaneously the sensor 90 checks the luminosity of the main flame and provides a signal only if the flame is too yellow. Assuming that no signal is received, gas is fed to the appliance until the time period set on the timer expires. A signal is then fed to the gate 80 and the alarm LED 60 comes on. Unless the button 56 is pressed to set the timed period running again then, after a 30 second delay, the solenoid operated valve 78 is closed.

In the event that any one of the sensors detects an improper operating characteristic then a signal is applied through the gates 92 and 94 to the gate 80. After a thirty second delay the solenoid valve 78 closes even though the time set on the timer may not have expired.

The solenoid valve 78, once closed, can only be re-opened by depressing the button 58.

Should there be a leak at the appliance 76 then gas flow will lift the piston 42 and the device 10 will send a signal to the gate 80. However, there will be an appropriate signal at the other input to the gate 80 if the timer is in its off position.

Some gas using appliances such as stoves do not have pilot flames associated with their burners. The gas tap of a burner that is to be used is simply turned on and the gas ignited using a match or other heat source. If the above described device is to be used to monitor gas flow to appliances which do not have pilot flames then the flow path constituted by the holes 46 or the bore 96 can be omitted as a continuous minor flow of gas is not in such circumstances required.

Each gas tap of the stove to which flow of gas is to be monitored has a microswitch associated with it. The microswitches can be normally closed or normally open and are arranged so as to be opened or closed as the gas tap is opened thereby to provide a signal indicating gas flow. Associated with each burner of the stove is a heat detector. In the event that, within a predetermined period of time comencing with a gas tap being opened and the microswitch associated with that gas tap thus changing its state, the heat detector does not produce a signal indicating that the main flame has been ignited, a warning is given and the valve 78 closed.

I claim:

1. An installation comprising a source of inflammable gas, a gas-using appliance, a gas line connecting said source to said appliance, a device for detecting gas flow in said gas line and producing a first output signal indicating gas flow, a timer which can be set to run for a predetermined period and with produces a second output signal during a timed period when said timer is running, and means for detecting said first and said second signals and for shutting off the gas flow in the event that there is a first output signal indicating gas flow but there is no second output signal from said timer.

2. An installation according to claim 1 and including sensor means for sensing if the pilot flame of the gas-using appliance is burning and causing said means for shutting off the gas flow to shut off gas flow in the absence of a pilot flame.

3. An installation according to claim 1 and including sensor means responsive to the luminosity of the main flame of the appliance for causing said means for shutting off the gas flow to shut off gas flow in the event that the luminosity of the main flame exceeds a predetermined level.

4. An installation according to claim 1 and including a heat sensor for detecting the heat of the main flame of the appliance and for causing said means for shutting off gas flow to shut off gas flow if it does not detect sufficient heat to determine that the main flame is burning.

5. A gas flow detecting device for incorporation into a gas flow monitoring installation comprising a gas inlet for connection to a gas supply, a gas outlet for connection to a gas-using appliance, a movable sealing element between said inlet and said outlet and having a first position in which it seals-off the outlet from the inlet and a second position to which it is displaced upon there being a major gas flow through the device and in which second position it permits gas flow from said inlet to said outlet, and means for producing an output signal upon said element being displaced by a major gas flow from said first position to said second position.

6. A device according to claim 5, and which comprises a vertical tube, said element being in said tube and free to move in said tube, the lower face of said element being exposed to the pressure at said inlet and the upper face of the element being exposed to the pressure at said outlet, said element, in use, lifting upon a major gas flow occurring, and said means detecting that said element has lifted.

7. A device according to claim 5 in which said means comprises a light source and a light sensitive cell, the element in one position preventing light from the source reaching said cell.

8. A device according to claim 5 and including an orifice connecting said inlet and said outlet and permitting a continuous minor gas flow through the device for a pilot flame of an appliance.

9. A device according to claim 8, in which said orifice places the lower end of said tube in communication with said outlet, and said tube has a hole in the wall thereof which is above the element while the element is in its lowermost position and below the element when the element is in its lifted position.

10. A device according to claim 8, in which said orifice is in said element and places the space below the element permanently in communication with the space above the element.

* * * * *